US011045673B2

(12) United States Patent
Broughton et al.

(10) Patent No.: US 11,045,673 B2
(45) Date of Patent: Jun. 29, 2021

(54) METHODS AND SYSTEM FOR FILLING A SUPPRESSANT CONTAINER

(71) Applicants: Tyco Building Services Products Limited, Middlesex (GB); Macron Safety Systems (UK) Limited, Norfolk (GB)

(72) Inventors: Timothy Broughton, Norfolk (GB); Alan Elder, Manchester (GB); John Walls, Norfolk (GB)

(73) Assignees: Tyco Building Services Products Limited, Middlesex (GB); Macron Safety Systems (UK) Limited, Norfolk (GB)

( * ) Notice: Subject to any disclaimer, the term of this patent is extended or adjusted under 35 U.S.C. 154(b) by 51 days.

(21) Appl. No.: 16/339,567

(22) PCT Filed: Oct. 4, 2017

(86) PCT No.: PCT/EP2017/075208

§ 371 (c)(1),
(2) Date: Apr. 4, 2019

(87) PCT Pub. No.: WO2018/065460

PCT Pub. Date: Apr. 12, 2018

(65) Prior Publication Data

US 2020/0047012 A1 Feb. 13, 2020

Related U.S. Application Data

(60) Provisional application No. 62/404,438, filed on Oct. 5, 2016.

(51) Int. Cl.
*A62C 13/62* (2006.01)
*A62C 35/02* (2006.01)
(Continued)

(52) U.S. Cl.
CPC ..... *A62C 13/62* (2013.01); *A62C 35/02* (2013.01); *B67D 7/08* (2013.01); *B67D 7/3272* (2013.01)

(58) Field of Classification Search
CPC ..... A62C 13/62; A62C 35/02; B67D 7/08; B67D 7/3272
See application file for complete search history.

(56) References Cited

U.S. PATENT DOCUMENTS 3,713,493 A * 1/1973 Hansen ..... A62C 13/006 169/75
3,875,980 A * 4/1975 Getz ..... B65B 1/16 141/83

(Continued)

FOREIGN PATENT DOCUMENTS

DE 19723788 12/1998
DE 69726828 1/2005

(Continued)

OTHER PUBLICATIONS

International Search Report and Written Opinion for International Application No. PCT/EP2017/075208, dated Dec. 15, 2017, 12 pages.

(Continued)

*Primary Examiner* — Timothy L Maust
(74) *Attorney, Agent, or Firm* — Foley & Lardner LLP

(57) ABSTRACT

Systems and methods for filling and pressurizing a container with liquid suppressant and nitrogen gas. A pressurized receiving container of nitrogen gas is provided at a predetermined gas pressure and liquid suppressant is added to the pressurized receiving container. The predetermined gas pressure provides a sufficient amount of nitrogen to saturate (Continued)

the added liquid suppressant and provide an operative head space pressure within the receiving container without the need for mechanized mixing.

16 Claims, 3 Drawing Sheets

(51) Int. Cl.
*B67D 7/08* (2010.01)
*B67D 7/32* (2010.01)

(56) References Cited

U.S. PATENT DOCUMENTS 3,942,561 A * 3/1976 Stoeffler ..... B65B 1/16 141/67
3,951,185 A * 4/1976 Bower ..... A62C 99/00 141/1
4,053,001 A * 10/1977 Healey ..... A62C 13/76 141/2
4,121,632 A * 10/1978 Zehr ..... F17C 5/00 141/378
4,337,803 A * 7/1982 Monte ..... F17C 5/00 141/2
4,657,055 A * 4/1987 Poulsen ..... F17C 5/005 141/83
8,967,208 B2 * 3/2015 Bridges ..... A62C 35/15 141/20
2006/0016608 A1 1/2006 Simpson et al.
2008/0163954 A1 * 7/2008 Brunn ..... F16J 12/00 141/3
2009/0032272 A1 * 2/2009 Duncan ..... A62C 13/64 169/85
2015/0354754 A1 * 12/2015 Whiteman ..... F17C 5/06 141/73

FOREIGN PATENT DOCUMENTS

DE 10 2007 036 877 2/2009
FR 2829399 A1 12/2003
WO WO-2016/013951 A1 1/2016

OTHER PUBLICATIONS

International Search Report and Written Opinion for International Application No. PCT/EP2017/075209, dated Dec. 15, 2017, 16 pages.

* cited by examiner

METHODS AND SYSTEM FOR FILLING A SUPPRESSANT CONTAINER

PRIORITY DATA & INCORPORATION BY REFERENCE

This application is an international application claiming the benefit of priority to U.S. Provisional Application No. 62/404,438 filed Oct. 5, 2016, which application is incorporated by reference in its entirety.

TECHNICAL FIELD

This invention relates generally to fire suppression systems and their suppressant supply systems. More specifically, the present invention is directed to methods and systems for providing a container of liquid suppressant at an operative pressure for a firefighting suppression systems.

BACKGROUND OF THE INVENTION

Known firefighting suppression systems employ a liquid suppressant that is vaporized to extinguish a fire. The vaporized suppressant extinguishes the fire principally by heat absorption. One suppressant that is used in these known suppression systems is 3M™ Novec™ 1230 Fire Protection Fluid ("Novec 1230") from 3M (having American Society of Heating, Refrigerating and Air-Conditioning Engineers (ASHRAE) designation FK-5-1-12). Novec 1230 is liquid at room temperature which facilitates ease in handling, storage and transfer. In order to use the Novec 1230 in these known firefighting suppression systems, the Novec 1230 is stored within one or more container assemblies as a super-pressurized suppressant to 25 bar (360 psi.) at 20 degrees Celsius using nitrogen gas. The containers for these known systems can vary in size, for example, from about 5 liters to 180 liters. In use, the containers are connected to system piping for distribution of the suppressant through the pipework as a fluid and then discharged as a gas through one or more nozzles.

Suppression systems can be installed in offshore platforms, data processing centers, tape storage facilities and many other facilities. It is desirable to transport the Novec 1230 in its liquid form to the site of the suppression system and then pressurize the suppressant onsite with nitrogen gas within a system container assembly. A known method of filling and pressurizing the containers, i.e., "charging" is to first add the liquid Novec (by weight) to the container then pressurize the container to an operative head space pressure of 25 Bar with nitrogen gas and then to agitate the container in a mechanized mixing process. Agitation causes some of the nitrogen to dissolve into the liquid Novec 1230, which causes the pressure to drop in the container. The known method includes repeatedly adding nitrogen gas and agitating the container until the desired head space pressure is back to 25 Bar and no longer drops. At this point in the process, it is believed that the Novec 1230 is sufficiently saturated with nitrogen so that the container head space pressure becomes stable. Given the size and the weight of some of the containers, the mechanized mixing process uses a mechanical mixer to turn, shake and flip or invert the container. A known mechanical mixer is a large and heavy mechanical mixing inverter having its own support frame requiring sufficient pneumatic and electrical supply sources and space in which to safely position, handle, secure and manipulate the heaviest of containers. Accordingly, a shortcoming of existing solutions for onsite filling is the need for mechanized mixing to handle the containers and sufficiently mix the Novec 1230 and nitrogen gas within service or operational limits for proper system operation.

There is a continuing need for methods and systems to fill and pressurize container assemblies for firefighting suppression systems without the logistic complexity and requirements of mechanized mixing used in the conventional charging operations. Adding to the problems in the currently known filling process is the difficulty in measuring the amount of nitrogen by weight that is required to saturate the Novec 1230 and pressurize the container. The weighing process is difficult because very accurate weighing scales are required. Scales capable of such accuracy can be easily damaged and are therefore not ideal for onsite filling where they would be subject to shock during transportation, etc. Moreover, the gas pressure during the fill process can cause the liquid suppressant to move within the container, which can generate undesirable excessive fluctuations in the weigh scale read out.

DISCLOSURE OF THE INVENTION

Preferred methods and systems are provided for a container of saturated liquid suppressant, preferably Novec 1230, at an operative pressure for a firefighting suppression system. The preferred method and systems provide for a charged container in which the need for mechanized mixing is eliminated. By eliminating mechanized mixing from the filling process, the preferred systems and methods can provide for a filled and pressurized container within a commercially comparable and more preferably an advantageous time period.

One preferred method of filling and pressurizing a container with firefighting liquid suppressant includes providing a pressurized receiving container containing nitrogen gas at a predetermined pressure; and adding an amount of firefighting liquid suppressant to the pressurized receiving container. Preferred embodiments of the fill method include first filling the receiving container with nitrogen and adding liquid suppressant to the container last.

In another preferred aspect, a system is provided for filling and pressurizing a container with firefighting liquid suppressant. The preferred system includes a receiving container defining an internal volume; a supply of nitrogen gas coupled to the receiving container for positively pressurizing the internal volume of the container to an internal pressure; a supply of liquid suppressant; and a transfer pump coupled to the receiving container and the supply of liquid suppressant for transferring the liquid suppressant to the receiving container against the internal pressure to define a head space pressure and more preferably a nominal operating head space pressure. By monitoring the head space pressure in the container, the need for a weigh scale at the receiving container can be eliminated.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

Figure 1:
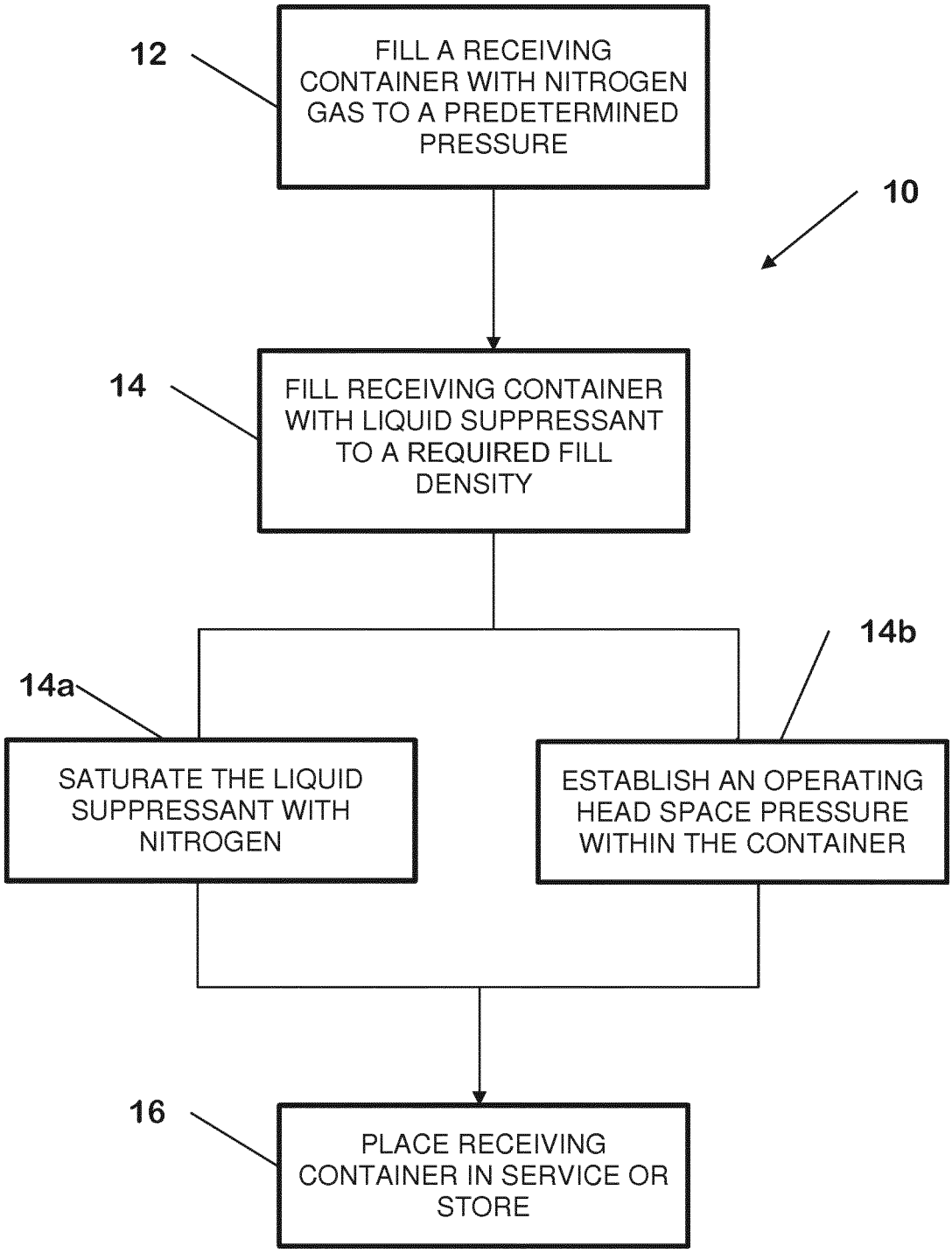
FIG. 1 is a flow chart of a first embodiment of a preferred method of filling and pressurizing a container with liquid suppressant and nitrogen gas.

Shown in FIG. 1 is a preferred method 10 for filling and pressurizing a receiving container with firefighting liquid suppressant, in this instance Novec 1230, extinguishing agent from 3M, for storage or installation in a firefighting suppressant system (not shown). The preferred method includes a first step 12 of filling a receiving container with nitrogen gas to a predetermined pressure to provide a pressurized receiving container of nitrogen gas. A second step 14 of the preferred method includes filling, adding or transferring to the receiving container a liquid suppressant to a desired or required fill density. The fill density preferably fills the container with an amount of liquid suppressant sufficient to operate the firefighting suppressant system to effectively address a fire. A preferred fill density of liquid suppressant for filling a receiving container preferably ranges from about 0.5 to about 0.85 kilogram per liter (kg/L) and more preferably ranges from about 0.5 to about 1 kilogram per liter (kg/L). The preferred second step 14 includes filling the receiving container with an amount of firefighting liquid suppressant that can be saturated by the nitrogen 14*a* within the container and define an operating head space pressure 14*a* within the container. As used herein, "operating head space pressure" or "operational head space pressure" is defined as the final stabilized pressure within the container above the liquid suppressant preferably at ambient temperature that is sufficient for storage of the pressurized liquid and operation in a firefighting suppressant system. A preferred operating head space pressure is at least 25 bar (363 psi.), preferably less than 45 bar (653 psi.) and more preferably is 25 bar. Preferably, the operating head space pressure varies directly with the ambient temperature and is preferably a nominal pressure that can vary within a defined range. As used herein, the ambient temperature preferably ranges from 20 degrees Celsius to 25 degrees Celsius and can range from 21-23 degrees Celsius and is more preferably 21 degrees Celsius. Preferably, the operating head space pressure is at least 25 bar (363 psi.), preferably less than 45 bar (653 psi.) and more preferably ranges between 22 psi. and 28 psi. to define a nominal operating head space pressure of 25 bar at the preferred ambient temperature of 21 degrees Celsius. The ambient temperature can be higher or lower depending upon the operation or storage conditions and the nominal operating head space pressure can vary accordingly. For example, where the ambient temperature is above 25 degrees Celsius, the nominal operating head space pressure can range from 26 bar to 30 bar for temperatures that may range from 30 degrees Celsius to 55 degrees Celsius. Where the ambient temperature is below 20 degrees Celsius, the nominal operating head space pressure can range from 20 bar to 25 bar for temperatures that may range from −20 degrees Celsius to less than 20 degrees Celsius. With the first and second steps 12, 14 completed, the pressurized container can be stored for future use of otherwise installed in a preferred concluding step 16 of the preferred method for use in the firefighting suppressant system.

The predetermined pressure of nitrogen in the first pressurizing step 12 defines the amount of nitrogen delivered to the receiving container that is preferably sufficient to saturate the liquid suppressant subsequently fed into the container and establish the desired operating head space pressure within the container after completing the filling step 14. The inventors have determined that by initially filling the receiving container with an adequate amount of nitrogen and then subsequently filling the pressurized container with liquid suppressant, the receiving container can be filled to an operational fill density and head space pressure without the need for a mechanized mixing process thereby overcoming the disadvantage of previously known charging methods. The inventors have determined that the preferred methods described herein provide for stable head space pressure over two or more days. By eliminating the need for mechanized mixing, the time to fill and pressurize a container is reduced or at least comparable to convention charging methods.

Figure 2:
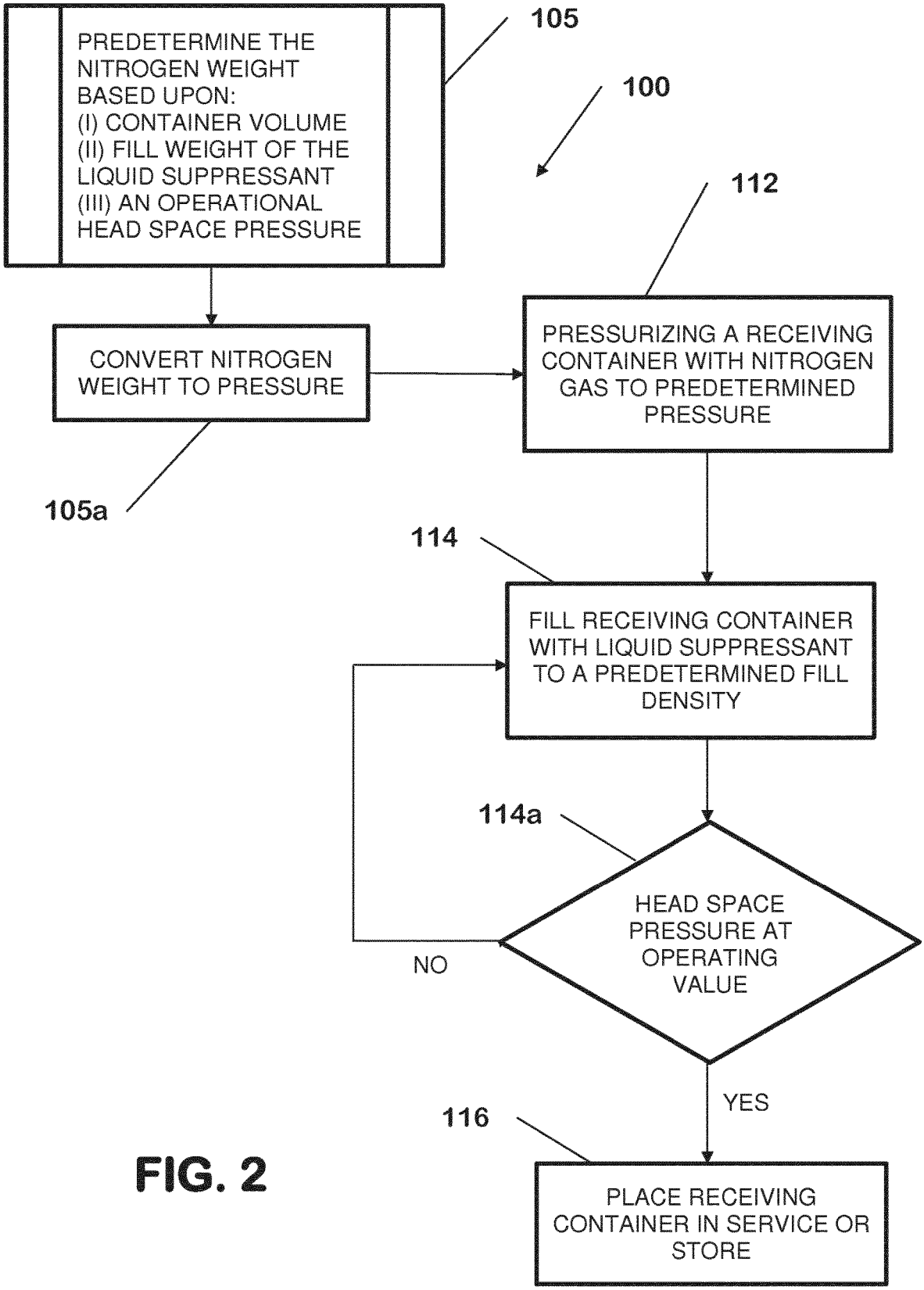
FIG. 2 is a flow chart of a second embodiment of a preferred method of filling and pressurizing a container with liquid suppressant and nitrogen gas.

Shown in FIG. 2 is another preferred embodiment 100 of the filling method. The preferred method 100 includes predetermining the pressure of the nitrogen 105 prior to the step of pressurize the receiving container with nitrogen 112. The preferred step of predetermining the nitrogen pressure 105 includes calculating the weight of nitrogen to be supplied to the receiving container based upon the internal volume of the receiving container, the total weight of the liquid suppressant to be supplied to the container in the second step 114 and the operational head space pressure. The predetermining step 105 preferably includes converting the calculated nitrogen weight to a total pressure value to define the amount of nitrogen to be delivered to the receiving container in the pressurizing step 112. Moreover, the predetermined pressure of nitrogen is preferably calculated at the ambient temperature for the receiving container in which the container is stored or operated.

The preferred method of filling 114 includes the step 114*a* of monitoring the head space pressure throughout the process step of filling the container with liquid suppressant. More specifically, the preferred process includes continually or intermittently determining or monitoring the head space pressure during the step of filling with liquid suppressant. In the course of filling the container with liquid suppressant, the head space pressure can vary until the operating pressure value is achieved and stabilized. If the measured head space pressure is below the operating head space pressure value, for example, below 25 bar, the filling step 114 is repeated or continued to fill the receiving container with liquid suppressant. If the head space pressure is at or within an acceptable range of the operating head space pressure, the filling step 114 is completed and the receiving container can be stored or place into service 116 to conclude the filling process 100. Again the preferred filling method 100 is performed and completed without mechanical agitation of the receiving container. In the preferred filling method 100, the head space pressures preferably never exceeds 45 bar and in the end, the preferred nominal operating head space pressure is preferably at least 25 bar at 21 degrees Celsius.

The preferred second step of transferring the liquid suppressant to fill the receiving container 14, 114 preferably transfers the liquid suppressant from a liquid suppressant supply of a known initial weight. The filling step 14, 114 can include monitoring the weight loss of the liquid supply to reach a predetermined weight value and indicate that the desired amount of liquid suppressant has been transferred from the supply to the receiving container.

Figure 3:
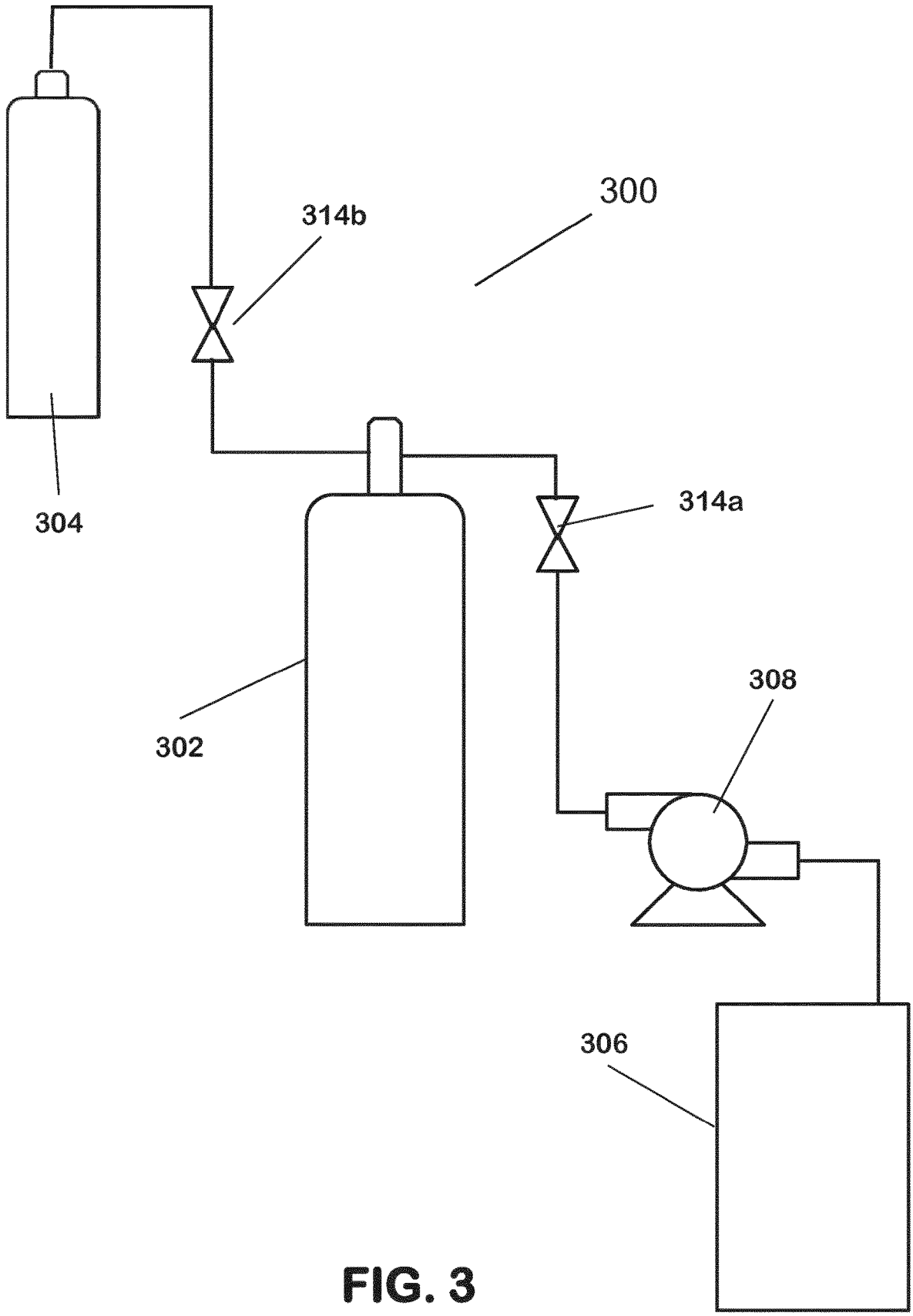
FIG. 3 is a schematic view of a preferred system for carrying out the methods of FIGS. 1-2.

Shown in FIG. 3 is a preferred system 300 for carrying out the previously described processes 10, 100 for filling and pressurizing a container with firefighting liquid suppressant. The preferred system 300 includes a receiving container 302 defining an internal volume to be filled and pressurized with nitrogen gas and liquid suppressant in a manner as described herein. The container 302 is preferably configured for both storage and connection to a firefighting system that employs a pressurized liquid suppressant. Accordingly, the preferred system is configured for installation and/or set up for liquid suppressant filling and pressurization at the site of the firefighting system or suppressant storage.

The preferred system 300 also includes a supply of nitrogen gas 304 coupled to the receiving container 302 for positively pressurizing the internal volume of the container 302 to a preferably predetermined internal pressure. The system 300 also includes a supply of liquid suppressant 306 and a transfer pump 308 coupled to each of the receiving container 302 and the supply of liquid suppressant 306 for transferring the liquid suppressant to the receiving container 302 against the internal pressure to define a head space pressure in the space 302*a* above the liquid within the receiving container 302 and more preferably establish a preferred nominal operating head space pressure. In a preferred embodiment of the transfer pump 308, liquid suppressant is transferred to the receiving container 302 against a head space pressure that exceeds 25 bar and more preferably against a head space pressure that ranges from 25-45 bar and that can more preferably transfer against a head space pressure that is greater than 45 bar.

In preferred embodiments of the systems and methods described herein, the preferred liquid suppressant employed is in this instance Novec 1230 extinguishing agent from 3M. The liquid suppressant can be a newly supplied material or recycled, for example, from the firefighting system validated to be in accordance with the original specification of the liquid suppressant. Moreover, the preferred supply of liquid suppressant 306 is a supply container having a fixed volume of liquid suppressant. For example, the supply of liquid suppressant 306 is embodied as a fifty-five gallon drum of suppressant. The transfer pump 308 pulls or draws the liquid suppressant from the supply container 306. As previously described, preferred embodiments of the filling method include measuring the weight loss in the liquid suppressant supply to determine the amount of liquid suppressant transferred to the receiving container. The preferred system 300 can include a weigh scale to measure the loss in weight of the liquid suppressant supply container 306 during transfer of liquid suppressant to the receiving container 302.

The system 300 includes multiple fittings for isolating any one of the interconnected receiving container 302, the liquid suppressant supply 306, the transfer pump 308 or the nitrogen supply 304. For example, fluid control from the transfer pump 308 is preferably controlled by shut-off valves, such as for example, a first ball valve 314*a* on the outlet side of the transfer pump 308. The nitrogen gas source 304 preferably include a shut-off valve 314*b* to control the flow and pressure of nitrogen gas to the container 302. The receiving container 302 is preferably embodied as a known storage cylinder assembly or container. The interconnections between system components can be made with appropriate pipe or hose connections and embodied in a central manifold.

The preferred system 300 can be used in the preferred methods of filling previously described. In one exemplary filling operation of the preferred method 100, a nitrogen gas pressure is determined based upon the size of the receiving container 302, the target fill weight of the liquid suppressant and the ambient temperature for saturation of the liquid suppressant and the establishing the operational head space pressure. The first nitrogen source 304 is connected to the receiving container 302 and the receiving container is pressurized to the predetermined nitrogen pressure. The nitrogen source 304 is then disconnected.

The transfer pump 308 is then started to transfer of liquid suppressant to the receiver container 302. In one preferred method of operation, the first ball valve 314*a* is closed and the transfer pump 308 is operated to build up a discharge pressure of 55 bar in the transfer piping on the outlet side of the pump 308 before or above the receiving container 302. When the discharge pressure reaches the desired level, the first ball valve 314*a* is opened for filling of the container 302. During the liquid suppressant transfer, the pressure inside the container is monitored using an appropriate gauge or sensor (not shown), such as for example a diaphragm pressure transducer, to determine the head space pressure in the receiver container 302. Additionally or alternatively, the system piping can include pressure sensors or gauge to monitor the pressure along the system piping. The change in weight of the liquid suppressant source 306 can be measured and monitored during transfer. Suppressant transfer continues until the target fill weight is reached in the receiver container 302 and the head space pressure measures in the preferred range of 25 bar to less than 45 bar and more preferably is 25 bar. The head space pressure in the receiving container could be up to 35 bar or greater. However it has been shown that over a period of a few days, the liquid suppressant will continue to dissolve the nitrogen and the head space pressure will drop to a desired operational level. Thus, the charging process is completed without mechanized mixing.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A method of charging a container with firefighting liquid suppressant, the method comprising:

providing a pressurized receiving container defining a volume and containing nitrogen gas at a predetermined pressure; and adding an amount of the firefighting liquid suppressant to the pressurized receiving container to define a nominal operating head space pressure within the pressurized receiving container, wherein providing the pressurized receiving container includes predetermining the predetermined pressure of the nitrogen gas from a calculated weight of nitrogen to saturate a predetermined weight of the firefighting liquid suppressant within the volume and provide the nominal operating head space pressure at ambient temperature.

2. The method of claim 1, wherein the nominal operating head space pressure within the pressurized receiving container ranges from at least 25 bar to less than 45 bar.

3. The method of claim 1, wherein adding the firefighting liquid suppressant includes transferring the firefighting liquid suppressant from a supply container and measuring a loss in weight of the supply container until the measured loss equals a predetermined weight value.

4. The method of claim 1, wherein adding the firefighting liquid suppressant includes transferring an amount of NOVEC™ 1230 extinguishing agent to the pressurized receiving container.

5. A system for filling and pressurizing a container with firefighting liquid suppressant, the system comprising:

a receiving container defining an internal volume;

a supply of nitrogen gas coupled to the receiving container for pressurizing the internal volume of the receiving container to an internal pressure;

a supply of liquid suppressant;

a transfer pump coupled to the receiving container and the supply of liquid suppressant for transferring the firefighting liquid suppressant to the receiving container against the internal pressure to define a head space pressure;

a first valve configured to selectively isolate the supply of nitrogen gas from the receiving container; and a second valve configured to selectively isolate the supply of liquid suppressant and the transfer pump from the receiving container, wherein the supply of nitrogen gas is configured to be coupled to the receiving container while the second valve isolates the supply of liquid suppressant and the transfer pump from the receiving container.

6. The system of claim 5, wherein the supply of liquid suppressant is a supply container having a fixed volume of liquid suppressant.

7. The system of claim 6, further comprising a pressure sensor to determine the head space pressure within the internal volume of the receiving container during transfer of the firefighting liquid suppressant.

8. The system of claim 7, wherein the transfer pump transfers the firefighting liquid suppressant to the receiving container against the head space pressure, the head space pressure ranging from 25-45 bar.

9. The system of claim 8, wherein the firefighting liquid suppressant is NOVEC™ 1230 extinguishing agent.

10. The system of claim 5, further comprising a pressure sensor to determine the head space pressure within the internal volume of the receiving container during transfer of the firefighting liquid suppressant.

11. The system of claim 5, wherein the transfer pump transfers the firefighting liquid suppressant to the receiving container against the head space pressure, the head space pressure ranging from 25-45 bar.

12. The system of claim 5, wherein the firefighting liquid suppressant is NOVEC™ 1230 extinguishing agent.

13. A method of charging a container with firefighting liquid suppressant, the method comprising:

pressurizing a receiving container with a predetermined weight of nitrogen to provide a pressurized receiving container containing nitrogen gas at a predetermined pressure; and adding an amount of the firefighting liquid suppressant to the pressurized receiving container to define a nominal operating head space pressure within the pressurized receiving container, wherein the predetermined weight of nitrogen is a function of an internal volume of the pressurized receiving container, a predetermined weight of the firefighting liquid suppressant, and the nominal operating head space pressure.

14. The method of claim 13, wherein the nominal operating head space pressure within the pressurized receiving container ranges from at least 25 bar to less than 45 bar.

15. The method of claim 13, wherein adding the firefighting liquid suppressant includes transferring the firefighting liquid suppressant from a supply container and measuring a loss in weight of the supply container until the measured loss equals a predetermined weight value.

16. The method of claim 13, wherein adding the firefighting liquid suppressant includes transferring an amount of NOVEC™ 1230 extinguishing agent to the pressurized receiving container.

* * * * *